United States Patent [19]

Pittet

[11] Patent Number: 4,854,296

[45] Date of Patent: Aug. 8, 1989

[54] MACHINE FOR CUTTING BUILDING MATERIALS BY MEANS OF AN ABRASIVE CABLE OR WIRE

[75] Inventor: Guy Pittet, Geneva, Switzerland

[73] Assignee: Forbeton-Betonbohr S.A., Troinex, Switzerland

[21] Appl. No.: 177,914

[22] Filed: Mar. 31, 1988

[51] Int. Cl.[4] ..... B28D 1/08

[52] U.S. Cl. ..... 125/21; 83/788; 83/795

[58] Field of Search ..... 125/21; 83/788, 794, 83/795, 801, 651.1, 581.1

[56] References Cited

U.S. PATENT DOCUMENTS 4,735,188 4/1988 Kubo ..... 125/21

*Primary Examiner*—Frederick R. Schmidt
*Assistant Examiner*—Maurina Rachuba
*Attorney, Agent, or Firm*—Lowe, Price, LeBlanc, Becker & Shur

[57] ABSTRACT

The machine comprises an elongate frame (1), on which is mounted a carriage (3) carrying a driving pulley (9) and an idle pulley (11), on which an abrasive cable (12) is wound. The length of the loop of cable or wire (12) formed between the carriage and the material to be cut can be changed by means of the number of winding turns of the cable or wire round the pulleys.

9 Claims, 1 Drawing Sheet

MACHINE FOR CUTTING BUILDING MATERIALS BY MEANS OF AN ABRASIVE CABLE OR WIRE

FIELD OF THE INVENTION

The subject of the present invention is a machine for cutting building materials by means of an abrasive cable or wire forming a closed loop driven in a rotational movement and under traction as result of the shift of the rotational drive means.

PRIOR ART

Cutting the materials of a building or structure for complete or partial demolition increasingly presents problems, above all in reinforced-concrete constructions of great thickness, where the use of large-diameter diamond-charged wheels raises many problems in terms of drive, dimensions and noise.

There are also known installations using an abrasive helicoidal wire, more recently a diamond-charged cable, driven in a rotational movement by a drive device mounted on a traction means shifting on ground-laid rails at the rate of advance of the cut. The length of the cables is selected according to the size of the cut. When diamond-charged cables of higher performance, but more expensive, are used, the length of the loop is reduced by severing and by joining the ends by means of screwing or crimping. Because of the overall size of such installations, they are used almost exclusively in the working of open-cut quarries where there are no or only insignificant space limitations for ensuring the shifting of the traction device. Furthermore, this traction device cannot shift in all directions, especially vertically.

SUMMARY OF THE INVENTION

The object of the present invention is to make it possible to cut, by means of an abrasive wire or cable, without limitation and in all positions, building materials of thicknesses below or above 60 cm in a restricted space, allowing it to be used in particular inside constructions of a standard type. The machine must therefore have a small overall size and a low weight.

The machine according to the invention is defined in that it comprises an elongate frame, on which is mounted a movable carriage carrying a grooved driving pulley and a grooved idle pulley which are mounted next to one another and round which the abrasive cable or wire can be wound once or several times, as required, a motor for the drive of the driving pulley, and a device for the linear drive of the carriage, the assembly as a whole being designed in such a way that the length of the loop of cable or wire formed between the carriage and the material to be cut can be changed by means of the number of winding turns of the cable or wire round the pulleys.

The machine can be used in all positions, particularly in the vertical, horizontal or inclined position.

The system for winding the cable slack by means of two grooved pulleys makes it possible to use the same fixed length of abrasive cable or wire from the start of cutting to the end.

It is possible to use a small-diameter driving pulley, since the friction of the cable is considerable because of its passage over two pulleys and the drive is thus ensured without slip. The winding of the slack prevents any loss of friction and thereby reduces the power required for driving the cable, thus contributing to the lightness and the small overall size of the machine.

Moreover, there is uniform wear of the abrasive cable or wire over its entire length. The presence of a single joining point minimizes the risk that the cable or wire will break as result of fatigue.

BRIEF DESCRIPTION OF THE DRAWINGS

The accompanying drawing illustrates an embodiment of the invention by way of example.

DESCRIPTION OF THE PREFERRED EMBODIMENT

Figure 1:
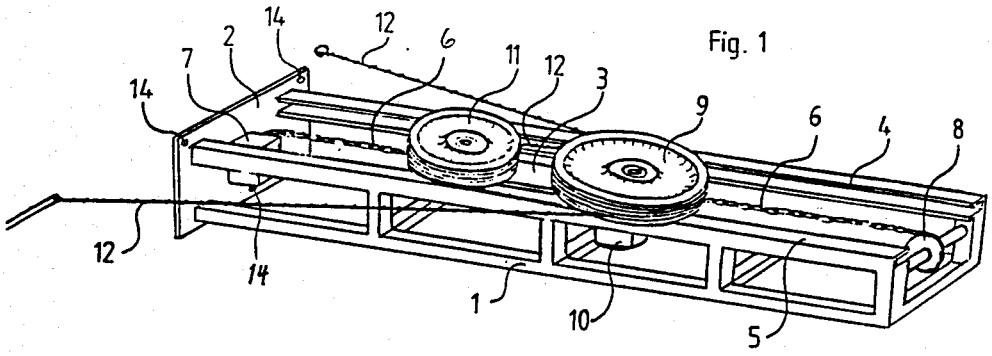
FIG. 1 is a perspective view of the machine, used in the horizontal position.

The machine illustrated in FIG. 1 comprises an elongate rigid frame 1 made of aluminum and equipped with a bearing baseplate 2 perpendicular to the axis of the frame. This frame carries a carriage 3 shiftable in two slideways 4 and 5 of the frame. These slideways having a U-shaped profile could also serve as running tracks for a carriage 3 equipped with rollers. At all events, the carriage is retained in all the directions transverse relative to the frame, in such a way that the frame can be used in any position. Attached to the carriage 3 are the ends of a chain 6, a single strand of which can be seen in FIG. 1, this chain being driven by means of a motor 7 fastened to the baseplate 2 and passing over a return means 8 mounted at the other end of the frame. The carriage 3 carries a driving pulley 9 having several grooves and driven by means of a hydraulic or electric motor 10. A grooved idle pulley 11 is also mounted on the carriage 3 between the driving pulley 9 and the baseplate 2. Instead of a single grooved pulley, it is possible, of course, to use several pulleys with a single groove, both for the pulley 9 and the pulley 11. An abrasive cable 12, for example a diamond-charged cable, is wound round the pulleys 9 and 11.

In order to drive the carriage 3, it would, of course, be possible to use other means, such as a rack or a jack.

Figure 2:
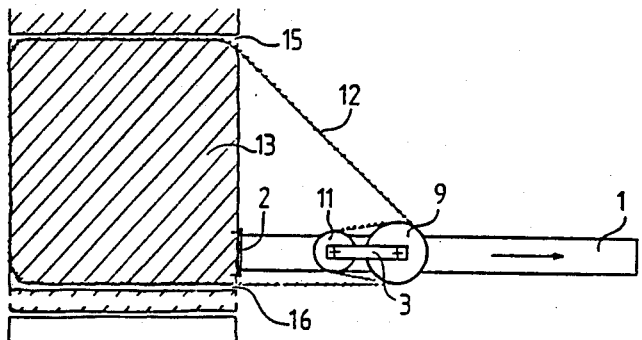
FIGS. 2 to 5 illustrate diagrammatically four successive working phases of the machine.
Figure 3:
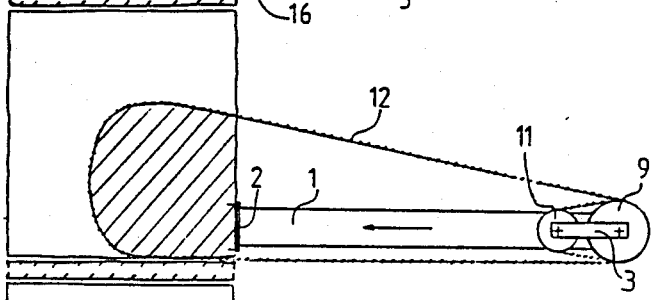
Figure 4:
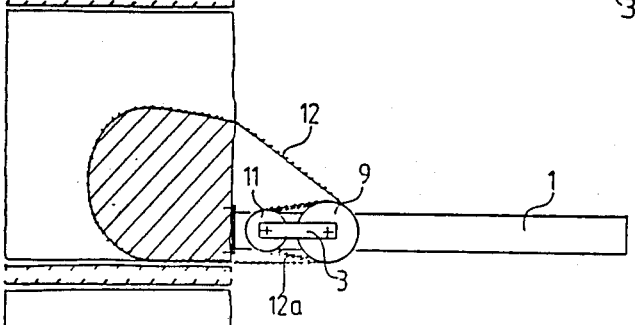
Figure 5:
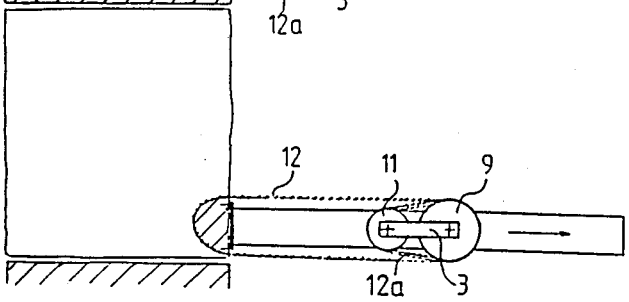

The mode of operation and use of the machine will now be described with reference to FIGS. 2 to 5. A section 13 of a concrete wall is to be cut out. Positioning the machine involves laying its baseplate 2 against the wall and anchoring this plate by means of spreader pins, using the holes 14 provided in it for this purpose. FIG. 2 can be either a plan view or an elevation view. Holes 15 and 16 are drilled in the wall to be cut, and the cable 12, initially open, is introduced through these. The ends of the cable 12 are subsequently joined together to form a closed loop which is passed once round the pulleys 9 and 11 of the carriage 3. If the section 13 to be cut is smaller, the cable 12 will be wound once more round the pulleys 9 and 11. The cable 12 is tensioned by means of the drive chain 6 of the carriage. The motor 10 is engaged, the effect of this being to drive the cable 12 in a rotational movement and begin the attack on the section 13 to be cut. The cable 12 is kept tensioned, and at the same time the carriage 3 is advanced towards the end of the frame 1 in the direction of the arrow by means of the motor 7. When the carriage 3 has reached the end of the frame 1 (FIG. 3), the motor 10 is stopped and the carriage 3 is returned towards the baseplate 2. The cable slack 12a is wound round the pulleys 9 and 11 so as to form a tensioned outer loop (FIG. 4). The operations according to FIG. 2 are subsequently repeated in order to cut the rest of the section 13 (FIG. 5).

Of course, the machine described above is open to many alternative forms of construction, only some of which have been mentioned by way of example in the course of the description.

I claim:

1. A machine for cutting building materials by means of an abrasive cable or wire (12) forming a closed loop driven in a rotational movement and under traction as result of a shift of a rotational drive means, defined in that it comprises an elongate frame (1), on which is mounted a movable carriage (3) carrying a grooved driving pulley (9) and a grooved idle pulley (11) which are mounted next to one another and round which the abrasive cable or wire (12) is wound a predetermined number of times, a motor (10) for driving the driving pulley, and a device for linearly driving the carriage (6, 7), thereby providing a change in the length of the loop of cable or wire formed between the carriage and the material to be cut by changing the number of winding turns of the cable or wire round the pulleys.

2. In a wire saw drive apparatus including a frame, a carriage movable relative to said frame, an abrasive cable for sawing through a material to be cut, said abrasive cable having a predetermined length, first drive means for moving said carriage relative to said frame, a drive pulley for said abrasive cable mounted to said carriage and second drive means for driving said drive pulley, the improvement comprising, in combination, loop length adjusting means for adjusting a length of a cutting loop pf said abrasive cable while maintaining the length of said abrasive cable substantially unchanged, and loop tension generating means for establishing tension in said abrasive cable.

3. An improved wire saw drive apparatus as recited in claim 2 wherein said loop length adjusting means comprises a plurality of grooves formed on said drive pulley for accepting any of a plurality of numbers of turns of said abrasive cable therein, thereby to establish a plurality of different loop lengths of said abrasive cable for cutting differently sized materials to be cut and for varying a distance between said carriage and the material to be cut.

4. An improved wire saw drive apparatus as recited in claim 3 wherein said loop length adjusting means further comprises an idle pulley mounted on said carriage, said idle pulley including at least one groove for accepting said abrasive cable therein to establish together with said plurality of grooves on said drive pulley a predetermined loop length for said abrasive cable.

5. An improved wire saw drive apparatus as recited in claim 2 wherein said loop tension generating means comprises a drive chain connected to said carriage and driven by said first drive means.

6. An improved wire saw drive apparatus as recited in claim 2 further comprising positioning means for positioning said apparatus agains said material to be cut, said positioning means including a pair of aligning holes for receiving pins therein to anchor said apparatus to said material to be cut.

7. A method of operating a wire saw drive apparatus including a frame, a carriage movable relative to said frame, an abrasive cable for sawing through a material to be cut, said abrasive cable having a predetermined length, first drive means for moving said carriage relative to said frame, a drive pulley for said abrasive cable and second drive means for driving said drive pulley, comprising the steps of:

establishing a loop of said abrasive cable around a material to be cut;

driving said drive pulley to drive said abrasive cable and to cut the material to be cut;

moving said carriage to maintain a tension in said abrasive cable; and varying a length of said loop of abrasive cable while maintaining substantially constant the length of said abrasive cable, thereby providing a fixed length of abrasive cable from a start to an end of a cutting operation.

8. The method of claim 7 wherein said varying step comprises the step of winding said abrasive cable a predetermined number of times about said drive pulley, thereby increasing friction between said drive pulley and said abrasive cable and reducing power required for driving said abrasive cable.

9. The method of claim 8 wherein said wire saw drive apparatus further includes an idle pulley mounted on said carriage, said idle pulley including a plurality of grooves thereon, and wherein said winding step comprises the further step of winding said abrasive cable in said at least one of said plurality of grooves around said idle pulley.

* * * * *